United States Patent [19]

Tanner

[11] Patent Number: 4,801,360

[45] Date of Patent: Jan. 31, 1989

[54] SURFACE TREATMENT OF ALUMINUM/SILICON ALLOYS

[75] Inventor: Christopher G. Tanner, Haverhill, United Kingdom

[73] Assignee: STC PLC, London, England

[21] Appl. No.: 876,236

[22] Filed: Jun. 19, 1986

[51] Int. Cl.[4] ..... C25D 11/16

[52] U.S. Cl. ..... 204/33; 204/58

[58] Field of Search ..... 204/33, 32.1, 58

[56] References Cited

U.S. PATENT DOCUMENTS

| | | | |
|---|---|---|---|
| 3,672,964 | 6/1972 | Bellis | 204/33 |
| 4,444,628 | 4/1984 | Furukawa et al. . | |

FOREIGN PATENT DOCUMENTS

| | | |
|---|---|---|
| 618202 | 2/1949 | United Kingdom . |
| 803357 | 10/1958 | United Kingdom . |
| 1137304 | 12/1968 | United Kingdom . |
| 1379850 | 1/1975 | United Kingdom . |

OTHER PUBLICATIONS

W. Hubner et al., The Practical Anodizing of Aluminum, MacDonald & Evans, London, 1960, pp. 28–35, 60–69.

A. Kenneth Graham, Electroplating Engineering Handbook, second edition, Reinhold Publishing Corp, New York, 1962, p. 185.

Frederick A. Lowenheim, Electroplating, McGraw-Hill Book Co, New York, 1978, pp. 452–463.

*Primary Examiner*—John F. Niebling

*Assistant Examiner*—William T. Leader

*Attorney, Agent, or Firm*—Limbach, Limbach & Sutton

[57] ABSTRACT

An alloy, e.g. an aluminum/silicon or aluminum/copper alloy, incorporating an anodizable and non-anodizable phase is selectively etched to remove the non-anodizable phase from the surface. The surface is then anodized to provide a continuous oxide film, e.g. to impart wear resistant properties to the surface.

7 Claims, 2 Drawing Sheets

S.E.M. PHOTOGRAPH OF UNETCHED SURFACE

SILICON X-RAY MAP OF ABOVE AREA

S.E.M. PHOTOGRAPH
OF ETCHED SURFACE

SILICON X-RAY MAP
OF ABOVE AREA

SURFACE TREATMENT OF ALUMINUM/SILICON ALLOYS

This invention relates to processes for the surface treatment of alloys to promote wear resistance.

Many metal alloy piece parts require some form of surface treatment prior to use to provide or enhance wear resistance. For example, aluminium silicon alloys are conventionally provided with a surface coating of nickel to achieve this effect. This of course is relatively costly.

Attempts have been made to treat alloys of this nature by a much cheaper anodixation process to produce a hard oxide film. However it has been found that the presence of a non-anodixable phase in the alloy surface prevents the formation of a continuous film having the necessary wear resistant properties.

The object of the present invention is to minimise or to overcome this disadvantage.

According to the invention there is provided a process for surface treatment of a metal alloy comprising an anodixable and a non-anodixable phase, the process including exposing the alloy to a selective etchants whereby the non-anodixable phase is removed from the surface, and anodixing the etched surface to provide a continuous wear resistant oxide film.

In one application the process may be applied to aluminium/silicon alloy piece parts for use in load bearing applications, e.g. vehicle brake systems. The process is not however limited to aluminium/silicon alloys, but is of general application to alloys incorporating an anodisable and a non-anodixable phase.

Typically the process is employed as a finishing stage after the alloy has been formed into a particular shape or configuration by conventional metal working processes. In some applications a dye may be incorporated in the anodic film to provide a decorative coating. The selective etching process may comprise a single etch or a plurality of etches applied sequentially.

Figure 1:
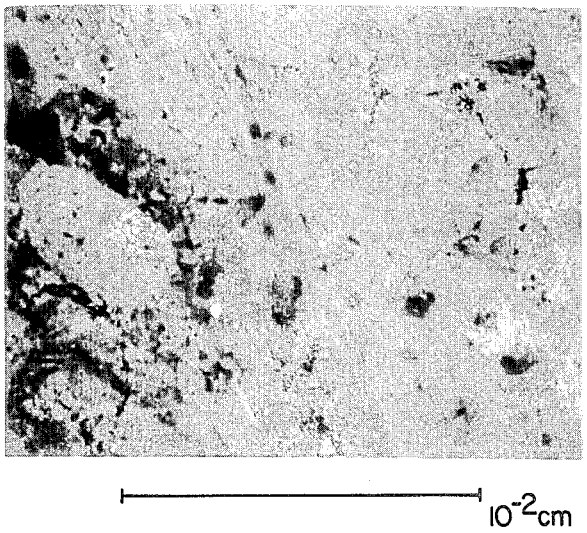
Figure 3:
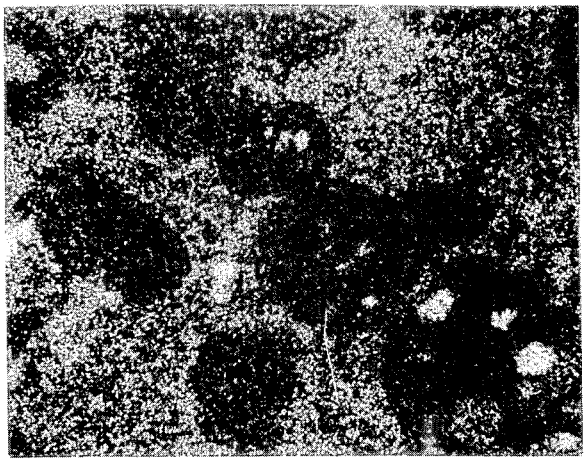
Figure 2:
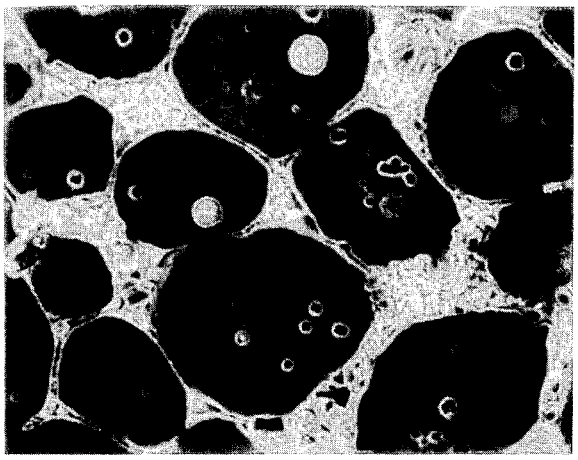
Figure 4:
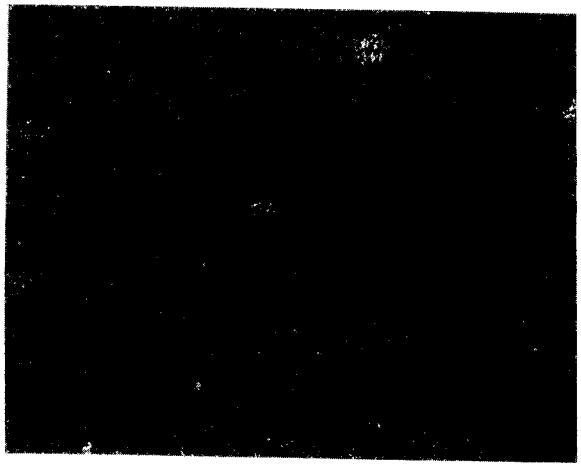

An embodiment of the invention will now be described with reference to the accompanying drawings in which:

FIGS. 1 and 2 are X-ray maps obtained from an aluminium/silicon alloy surface respectively before and after selective etching, and FIGS. 3 and 4 are scanning electron microscope (SEM) views corresponding to the X-ray maps of FIGS. 1 and 2.

We have found for example that aluminium/silicon alloys may be surface etched to remove the silicon phase by a two stage process, each stage employing a selective etchant. Typically we employ fluoride coating etchants. The first etch may employ a solution of ammonium bifluoride in nitric acid followed by a second etch in aqueous hydrofluoric acid. Typically the concentration of ammonium bifluoride in the first etch is 30 g/1 and the alloy is exposed to this etch at room temperature for a period of 20 to 60 seconds. Advantageously the exposure time is 28 to 32 seconds. A 10% solution of hydrogen fluoride in water is suitable for the second etch for which the exposure time is 5 to 20 seconds and preferably 14 to 16 seconds. In some applications this two stage etching may be repeated one or more times. The effects of this selective etching in removing the silicon phase from the alloy surface is demonstrated in FIGS. 1 to 4. In FIGS. 1 and 2 it should be noted that X-rays are emitted only from silicon atoms in the alloy surface, the lighter aluminium atoms having substantially no effect on the X-ray pattern. As can be seen from FIGS. 3 and 4, the effect of the etch is to remove silicon from the alloy surface to leave a substantially pure aluminium surface which can then be anodised.

After etching has been effected the treated surface may be protected against wear by anodixation. For this purpose we prefer to employ a saturated solution of oxalic acid in aqueous sulphuric acid at a reduced temperature. Advantageously the anodixation process is performed at or below 10° C. and typically at 0° C. Other anodixation processes can of course be employed and these will be well known to those skilled in the art.

To illustrate the techniques described herein an aluminium/silicon alloy was selectively etched and then anodised to provide an oxide film thickness of 20 microns. The treated surface was then wear tested by an abrasion technique. Breakdown of the oxide film was detected by electrical conductivity between the wear inducing tool and the bulk alloy. For comparison similar wear test measurements were carried out on an anodixed unetched conventional alloy. The results are summarised in Table 1 below.

TABLE 1

| Sample | Anodisation | Film Thickness μm | Average wear Cycles × 1000 |
|---|---|---|---|
| Conventional Al alloy control | oxclic acid/ $H_2SO_4$ | | |
| | (a) 10° C. | 20 | 135 |
| | (b) 0° C. | 20 | 260 |
| Al/Si alloy Selectively etched | oxclic acid/ $H_2SO_4$ | | |
| | (a) 10° C. | 20 | 127 |
| | (b) 0° C. | 20 | 212 |
| Al/Si alloy standard surface treatment | standard anodisation process | 35 | 91 |

As can be seen from the Table, the results achieved by the technique described herein are comparable with those obtained with conventional alloys. The technique also compares very favourably with conventional processes for the treatment of aluminium silicon alloys.

Aluminium/copper alloys may be treated in a similar way. For this purpose we prefer to employ an etch comprising a mixture of sulphuric acid and nitric acid. After treatment with the etch, the alloy surface may be anodised as previously described.

The technique is not of course limited to aluminium alloys but is of general application to alloys incorporating an anodixable and a non-anodixable phase.

It will be appreciated that alloys comprising an anodixable and a non-anodixable phase may also incorporate minor quantities of other metals, e.g. manganese, iron, nickel, magnesium, zinc or mixtures thereof.

I claim:

1. A process for the treatment of a surface of an aluminum/silicon alloy having anodixable and non-anodixable phases, said process comprising exposing the surface of the aluminum/silicon alloy to a first etchant, said first etchant comprising a solution of ammonium bifluoride in nitric acid, to selectively remove the non-anodixable phase at the surface of the alloy, followed by exposing the surface of the alloy to a second etchant, said second etchant comprising aqueous hydrofluoric acid, and thereafter anodizing the etched surface to provide an oxide film.

2. A process as claimed in claim 1, wherein the alloy is exposed to the first etchant for a period of 20 to 60 seconds.

3. A process as claimed in claim 1 wherein the alloy is exposed to the second etchant for a period of 5 to 20 seconds.

4. A process as claimed in claim 1, wherein sequential exposure to the two etchants is repeated.

5. A process as claimed in claim 1, wherein the etched surface is anodixed with a solution of oxalic acid in aqueous sulphuric acid.

6. A process as clained in claim 1, wherein anodixation is effected at a temperature between 0° and 10° C.

7. A process as claimed in claim 1, wherein the anodixed surface incorporates a dye.

* * * * *